US009429905B2

(12) United States Patent
Shimizu

(10) Patent No.: US 9,429,905 B2
(45) Date of Patent: Aug. 30, 2016

(54) CARTRIDGE CONFIGURED OF TWO UNITS AND IMAGE FORMING APPARATUS THAT ACCOMMODATES THE CARTRIDGE

(71) Applicant: Brother Kogyo Kabushiki Kaisha, Nagoya-shi, Aichi-ken (JP)

(72) Inventor: Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/855,976

(22) Filed: Sep. 16, 2015

(65) Prior Publication Data

US 2016/0004213 A1 Jan. 7, 2016

Related U.S. Application Data

(63) Continuation of application No. 14/141,863, filed on Dec. 27, 2013, now Pat. No. 9,141,084.

(30) Foreign Application Priority Data

Dec. 28, 2012 (JP) ..... 2012-286698

(51) Int. Cl.
*G03G 15/00* (2006.01)
*G03G 21/18* (2006.01)

(52) U.S. Cl.
CPC ..... *G03G 21/1839* (2013.01); *G03G 21/1817* (2013.01); *G03G 21/1875* (2013.01); *G03G 21/1896* (2013.01); *G03G 2221/1892* (2013.01)

(58) Field of Classification Search
CPC ..... G03G 21/1896; G03G 21/1817; G03G 21/1875; G03G 21/1676; G03G 2221/1853; G03G 2221/1892; G03G 21/1839
See application file for complete search history.

(56) References Cited

U.S. PATENT DOCUMENTS

| | | | | |
|---|---|---|---|---|
| 6,298,202 | B1 | 10/2001 | Fushiya et al. | |
| 9,141,084 | B2 * | 9/2015 | Shimizu | G03G 21/1875 |
| 2008/0205931 | A1 | 8/2008 | Ishikawa | |
| 2011/0243578 | A1 | 10/2011 | Ukai et al. | |
| 2012/0243882 | A1 | 9/2012 | Carot | |
| 2013/0084084 | A1 | 4/2013 | Itabashi et al. | |
| 2013/0170845 | A1 | 7/2013 | Itabashi | |

FOREIGN PATENT DOCUMENTS

| | | |
|---|---|---|
| JP | 2001-222204 A | 8/2001 |
| JP | 2011-203493 A | 10/2011 |

* cited by examiner

*Primary Examiner* — Sophia S Chen
(74) *Attorney, Agent, or Firm* — Banner & Witcoff, Ltd.

(57) ABSTRACT

A cartridge mountable in an image forming apparatus includes a first unit that stores developer and a second unit that accommodates the first unit. The first unit includes a first detected part configured to be displaced irreversibly from a first-unit new-product position to a first-unit used position upon receipt of a driving force from the image forming apparatus, the first detected part contacting a detector provided in the image forming apparatus while being displaced from the first-unit new-product position to the first-unit used position to be detected by the detector. The second unit includes a second detected part configured to be displaced irreversibly from a second-unit new-product position to a second-unit used position upon receipt of a driving force from the image forming apparatus, the second detected part contacting the detector while being displaced from the second-unit new-product position to the second-unit used position to be detected by the detector.

10 Claims, 17 Drawing Sheets

DRUM UNIT: NEW
DEVELOPING UNIT: NEW

DRUM UNIT: NEW
DEVELOPING UNIT: OLD

DRUM UNIT: OLD
DEVELOPING UNIT: NEW

DRUM UNIT: OLD
DEVELOPING UNIT: OLD

DRUM UNIT: NEW
DEVELOPING UNIT: NEW

DRUM UNIT: NEW
DEVELOPING UNIT: OLD

DRUM UNIT: OLD
DEVELOPING UNIT: NEW

DRUM UNIT: OLD
DEVELOPING UNIT: OLD

CARTRIDGE CONFIGURED OF TWO UNITS AND IMAGE FORMING APPARATUS THAT ACCOMMODATES THE CARTRIDGE

CROSS REFERENCE TO RELATED APPLICATION

This application is a continuation of U.S. patent application Ser. No. 14/141,863 filed Dec. 27, 2013, which claims priority from Japanese Patent Application No. 2012-286698 filed Dec. 28, 2012. The entire contents of the priority applications are incorporated herein by reference.

TECHNICAL FIELD

The present invention relates to an image forming apparatus and a cartridge that is detachably mounted in a body of the image forming apparatus.

BACKGROUND

One conventional cartridge that is detachably mounted in a body of an image forming apparatus is configured of a toner case that accommodates toner, and a process case in which the toner case is detachably mounted (see Japanese Patent Application Publication No. 2011-203493). In this conventional image forming apparatus, a photosensitive drum provided in the process case, and a sensor gear is provided on the toner case. The sensor gear has a contact protrusion and is capable of rotating irreversibly in one direction. When the cartridge is mounted in the body of the image forming apparatus, the sensor gear is driven to rotate by a driving force inputted from the body of the image forming apparatus. When the toner case is a new product, the contact protrusion will contact an actuator provided in the body as the sensor gear rotates, enabling the image forming apparatus to acquire information on the toner case, such as whether the toner case is new.

SUMMARY

When the cartridge used in the image forming apparatus is configured of two units, as in the above example, it would be desirable to have an ability to detect whether both units are new. However, new-product detection for two units would require separate actuators, separate photosensors for detecting the motion of these actuators, and the like, leading to a rise in manufacturing costs.

In view of the foregoing, it is an object of the present invention to provide an image forming apparatus equipped with a cartridge that is configured of two units, and a low-cost solution for acquiring information (new-product detection) on both units.

In order to attain the above and other objects, there is provided a cartridge configured to be detachably mountable in an image forming apparatus provided with a detector. The cartridge includes: a first unit configured to store developer therein; and a second unit having a photosensitive drum and configured to detachably accommodate the first unit. The first unit includes a first detected part configured to be displaced irreversibly from a first-unit new-product position to a first-unit used position upon receipt of a driving force from the image forming apparatus, the first detected part being configured to contact the detector while being displaced from the first-unit new-product position to the first-unit used position to permit the first detected part to be detected by the detector. The second unit includes a second detected part configured to be displaced irreversibly from a second-unit new-product position to a second-unit used position upon receipt of a driving force from the image forming apparatus, the second detected part being configured to contact the detector while being displaced from the second-unit new-product position to the second-unit used position to permit the second detected part to be detected by the detector.

According to another aspect of the present invention, there is also provided an image forming apparatus configured to detachably accommodate the cartridge configured of the first unit and the second unit. The detector includes: a contact arm, a biasing member, a biasing member and a light-receiving element. The contact arm is configured to be contacted by each of the first detected part and the second detected part and to pivotally move between the detection position and the non-detection position in accordance with contact and separation relative to each of the first detected part and the second detected part. The biasing member is configured to apply a biasing force to the contact arm to bias the contact arm toward the non-detection position. The light-emitting element is configured to emit light to detect whether the contact arm pivotally moves, and the light-receiving element is configured to receive the light from the light-emitting element. The contact arm further includes a first shielding portion and a second shielding portion. The first shielding portion is configured to enter between the light-emitting element and the light-receiving element to shield the light when one of the first detected part and the second detected part is separated from the contact arm and configured to be retracted from between the light-emitting element and the light-receiving element when the one of the first detected part and the second detected part contacts the contact arm. The second shielding portion is configured to enter between the light-emitting element and the light-receiving element to shield the light when a remaining one of the first detected part and the second detected part further contacts the contact arm while the one of the first detected part and the second detected part is in contact with the contact arm.

DETAILED DESCRIPTION

First Embodiment

A process cartridge 5 as an example of a cartridge according to a first embodiment of the present invention will be described with reference to FIGS. 1 through 11(*d*).

A laser printer 1 is an example of an image forming apparatus of the first embodiment that is configured to detachably accommodate the process cartridge 5.

1. Overall Structure of the Laser Printer

In the following description, directions related to the laser printer 1 will be given based on the perspective of a user using the laser printer 1. Specifically, the right side of the laser printer 1 in FIG. 1 will be considered the front side, and the left side of the printer 1 in FIG. 1 will be considered the rear side. Further, the near side in FIG. 1 will be considered the left side, and the far side in FIG. 1 will be considered the right side. A vertical direction in FIG. 1 will be referred to as a top-down direction with regard to the laser printer 1.

The laser printer 1 is configured to form a toner image, transfer the toner image onto a sheet S, and thermally fix the toner image on the sheet S.

Figure 1:
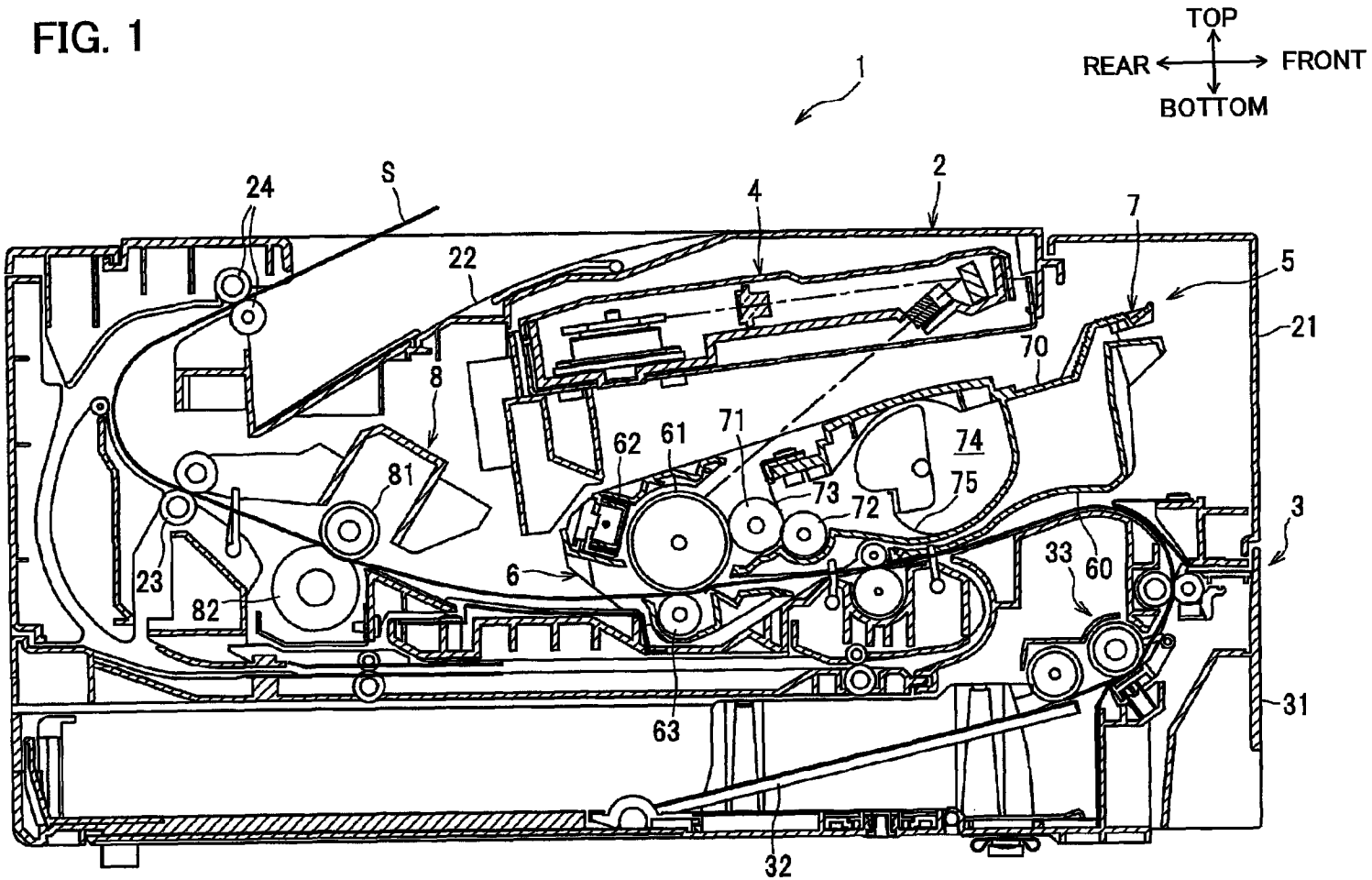
FIG. 1 is a schematic cross-sectional diagram illustrating a general configuration of a laser printer according to a first embodiment of the present invention.

As shown in FIG. 1, the laser printer 1 is provided with a main casing 2 within which provided are a sheet-feeding unit 3, an exposing unit 4, the process cartridge 5, and a fixing unit 8.

The main casing 2 is provided with a front cover 21. When the front cover 21 configured to be opened and closed to expose and cover an aperture formed in a front end portion of the main casing 2.

The sheet-feeding unit 3 is disposed at a lower portion of the main casing 2. The sheet-feeding unit 3 mainly includes a sheet tray 31 for accommodating the sheets S, a sheet-lifting plate 32, and a sheet-feeding mechanism 33. The sheets S stacked in the sheet tray 31 are lifted upward by the sheet-lifting plate 32, and are separated one by one by the sheet-feeding mechanism 33 to be conveyed to the process cartridge 5.

The exposing unit 4 is disposed in an upper portion of the main casing 2. The exposing unit 4 includes a laser source (not shown), a polygon mirror, lenses, and a reflection minor (shown without reference numerals). In the exposing unit 4, the laser source emits a laser beam, a path of which is indicated by a chain line in FIG. 1, based on image data. The laser beam is irradiated on a surface of a photosensitive drum 61 at a high speed, thereby exposing the surface of the photosensitive drum 61 to light.

The process cartridge 5 is configured to be disposed below the exposing unit 4 when mounted in the main casing 2. The process cartridge 5 is configured to be received in the main casing 2 through the aperture formed in the main casing 2 when the front cover 21 is opened.

The process cartridge 5 includes a drum unit 6 and a developing unit 7.

The drum unit 6 mainly includes a photosensitive drum 61, a charger 62 and a transfer roller 63.

The developing unit 7 is configured to be mounted in and removed from the drum unit 6 and includes a developing roller 71, a supply roller 72, a thickness regulation blade 73, a toner accommodation chamber 74 for accommodating toner, and an agitator 75.

In the process cartridge 5, the charger 62 applies a uniform charge to a peripheral surface of the photosensitive drum 61. Subsequently, the exposing unit 4 exposes the peripheral surface of the photosensitive drum 61 to light, thereby forming an electrostatic latent image on the peripheral surface of the photosensitive drum 61 based on the image data. In the meantime, while the agitator 75 agitates the toner stored in the toner accommodation chamber 74, the supply roller 72 supplies the toner onto the developing roller 71. As the developing roller 71 rotates, the thickness regulation blade 73 regulates the thickness of toner on the developing roller 71. The toner is thus carried on the peripheral surface of the developing roller 71 as a thin layer of uniform thickness.

The toner on the developing roller 71 is then supplied to the latent image formed on the peripheral surface of the photosensitive drum 61, thereby developing the latent image into a visible toner image. Subsequently, the toner image is transferred onto the sheet S conveyed from the sheet-feeding unit 3 as the sheet S passes between the photosensitive drum 61 and the transfer roller 63.

The fixing unit 8 is disposed rearward of the process cartridge 5 within the main casing 2. The fixing unit 8 includes a heat roller 81 and a pressure roller 82 disposed in opposition to each other. The pressure roller 82 is in pressure-contact with the heat roller 81. In the fixing unit 8, the toner image transferred onto the sheet S is thermally fixed thereon as the sheet S passes between the heat roller 81 and the pressure roller 82. The sheet S with the toner image fixed thereon is finally discharged onto a discharge tray 22 formed on an upper surface of the main casing 2 by conveying rollers 23 and discharge rollers 24.

2. Detailed Description of the Process Cartridge

A detailed structure of the process cartridge 5 will be described with reference to FIGS. 2 to 5.

In the following description of the process cartridge 5, the process cartridge 5 is assumed to be new (in a state where the process cartridge 5 is shipped as a new product), unless otherwise defined. In other words, the process cartridge 5 is assumed to be in a state shown in FIG. 7 where a first detected part 115 and a second detected part 215 are at a new-product position, as will be described later.

Figure 2A:
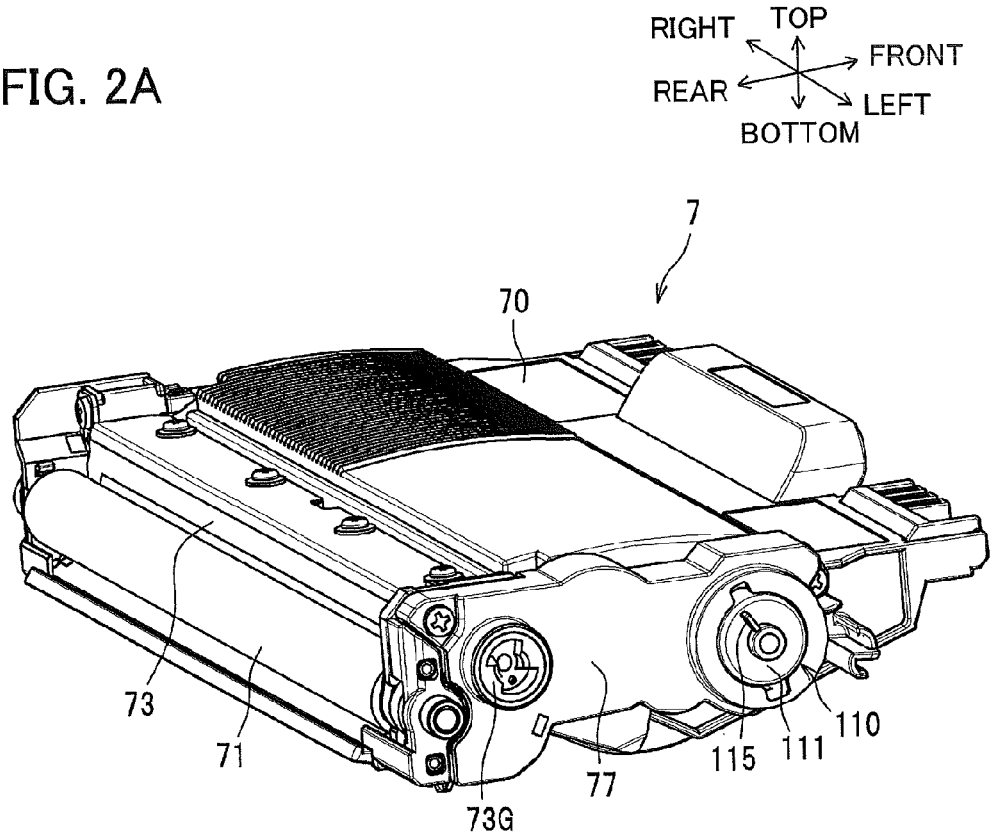
FIG. 2A is a perspective view of a developing unit according to the first embodiment.
Figure 2B:
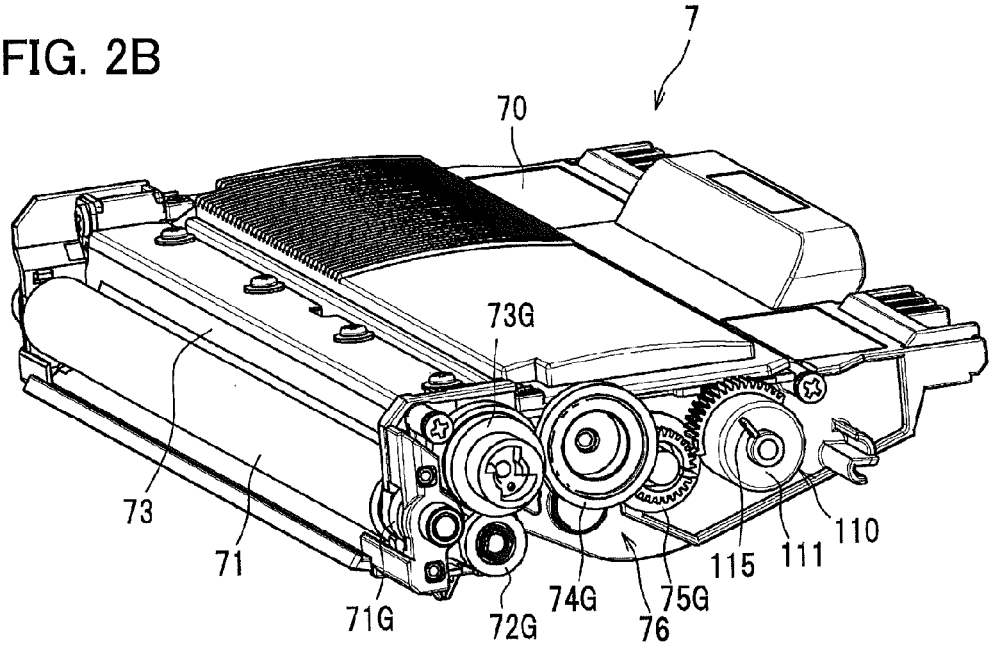
FIG. 2B is a perspective view of the developing unit according to the first embodiment, wherein a cover has been moved.

The developing unit 7 includes a developing-unit frame 70 configuring an external appearance of the developing unit 7. In addition to the developing roller 71 and thickness regulation blade 73 described above, the developing unit 7 also includes a drive-transmitting mechanism 76, a first sensor gear 110, and a cover 77. The developing-unit frame 70 has a left surface to which the cover 77 is attached for covering the drive-transmitting mechanism 76 and first sensor gear 110, as shown in FIGS. 2A and 2B.

The drive-transmitting mechanism 76 is provided on the left surface of the developing-unit frame 70 and is configured of an input gear 73G into which a driving force is inputted from the main casing 2, a developing-roller gear 71G and a supply-roller gear 72G engaged with the input gear 73G, and an agitator gear 75G engaged with the input gear 73G through an intermediary gear 74G. The developing-roller gear 71G, supply-roller gear 72G, and agitator gear 75G transmit the driving force to the developing roller 71, supply roller 72, and agitator 75, respectively.

The first sensor gear 110 primarily includes a gear part 111, and a first detected part 115. The first detected part 115 can be irreversibly rotated (displaced) from the new-product position shown in FIGS. 3 and 7 to a used position in which a toothless portion 113 described later confronts the agitator gear 75G.

Figure 3:
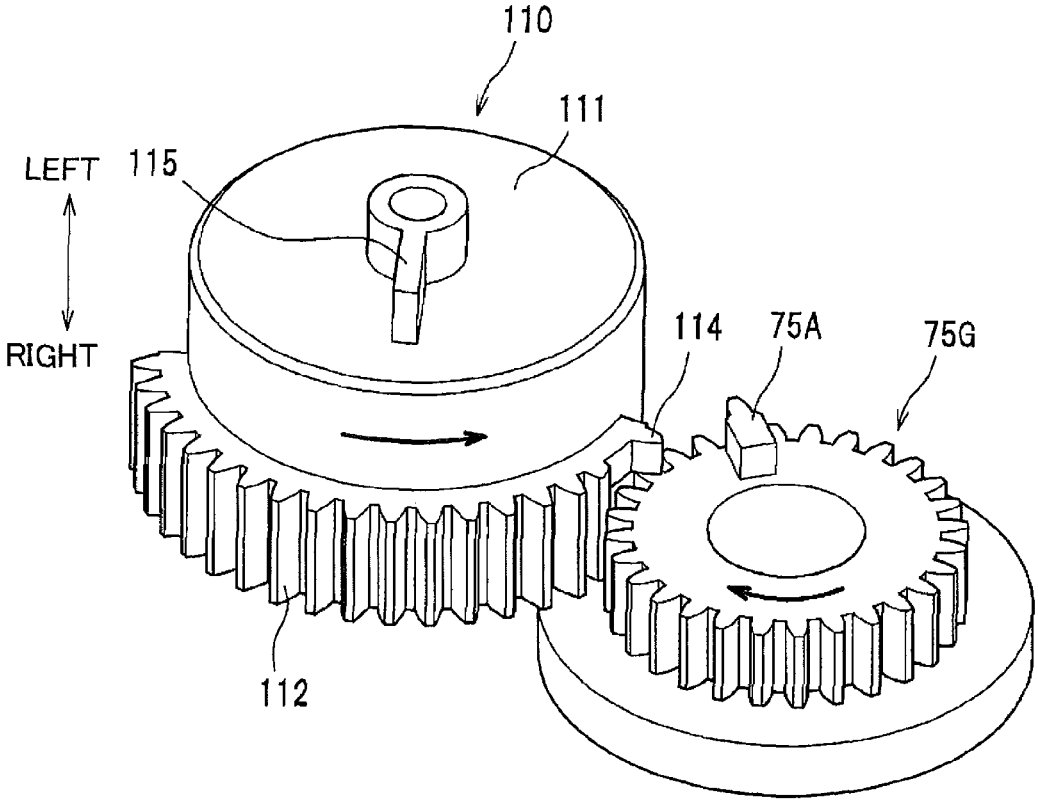
FIG. 3 is a perspective view of a first sensor gear and an agitator gear provided on the developing unit of the first embodiment.

As shown in FIG. 3, the gear part 111 is arranged such that its circumferential surface confronts the agitator gear 75G. The circumferential surface of the gear part 111 is provided with a toothed portion 112 and the toothless portion 113 (see FIG. 7). A protruding part 114 is also provided on the circumferential surface of the gear part 111 at the downstream end of the toothed portion 112 with respect to a direction in which the first sensor gear 110 rotates (indicated by an arrow in FIG. 3).

When the toothed portion 112 faces and engages with the agitator gear 75G, a driving force is transmitted from the agitator gear 75G to the toothed portion 112, rotating the first sensor gear 110. However, when the toothless portion 113 confronts the agitator gear 75G, the driving force is not transmitted from the agitator gear 75G and thus the first sensor gear 110 is not rotated.

The protruding part 114 protrudes radially outward from the peripheral surface of the gear part 111 at a position offset from the gear teeth of the agitator gear 75G in a left-right direction (axial direction of the first sensor gear 110). When the first detected part 115 is in the new-product position shown in FIG. 3, the protruding part 114 and the gear teeth of the agitator gear 75G overlap in the left-right direction but do not interfere with (contact) each other.

The first detected part 115 is provided on a left surface of the gear part 111 and protrudes leftward therefrom at a position offset radially from the rotational center of the gear part 111.

The agitator gear 75G has a left surface on which a protruding part 75A is provided. The protruding part 75A protrudes leftward from the agitator gear 75G at a position offset radially from the rotational center of the same. The protruding part 75A rotates (is displaced) along with the rotation of the agitator gear 75G in a direction of the arrow indicated in FIG. 3. The protruding part 75A is positioned to contact the protruding part 114 on the first sensor gear 110 in order to start the first sensor gear 110 rotating.

Figures 4A, 4B:
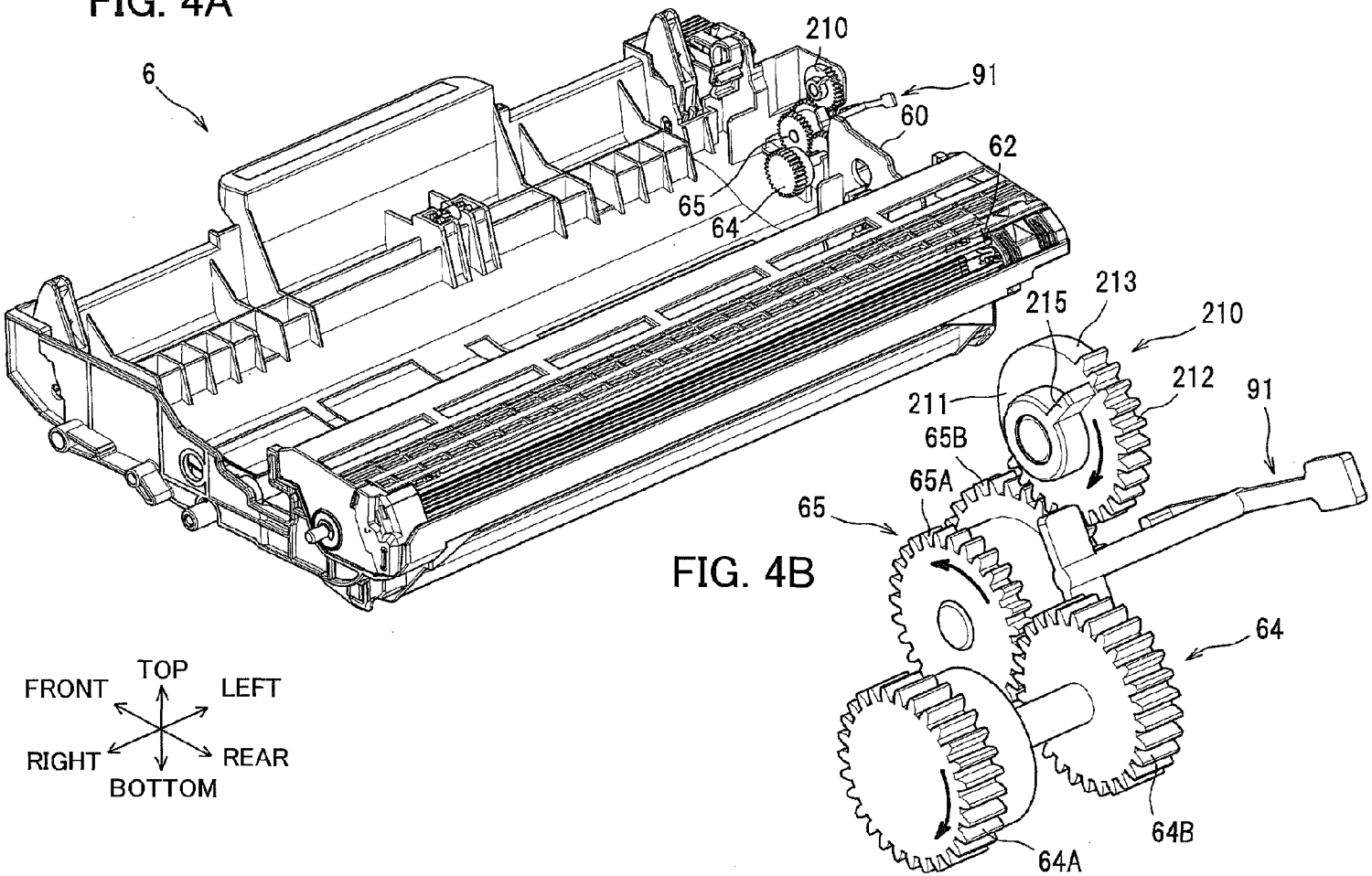
FIG. 4A is a perspective view of a drum unit according to the first embodiment.
FIG. 4B is an enlarged view of a second sensor gear and its peripheral components provided on the drum unit according to the first embodiment.

In addition to the photosensitive drum 61 and the charger 62 (see FIG. 1) described above, the drum unit 6 further includes a drum-unit frame 60 configuring an external appearance of the drum unit 6 on which transmission gears 64 and 65, and a second sensor gear 210 are provided, as shown in FIG. 4A.

As shown in FIG. 4B, the transmission gears 64 and 65 function to transmit a driving force to the second sensor gear 210. The transmission gears 64 and 65 have respective inner gear parts 64A and 65A disposed on the inside in the left-right direction (right side), and outer gear parts 64B and 65B disposed on the outside in the left-right direction (left side). The outer gear part 64B is engaged with the inner gear part 65A, and the outer gear part 65B can engage with a toothed portion 212 of the second sensor gear 210 described later.

Figure 5:
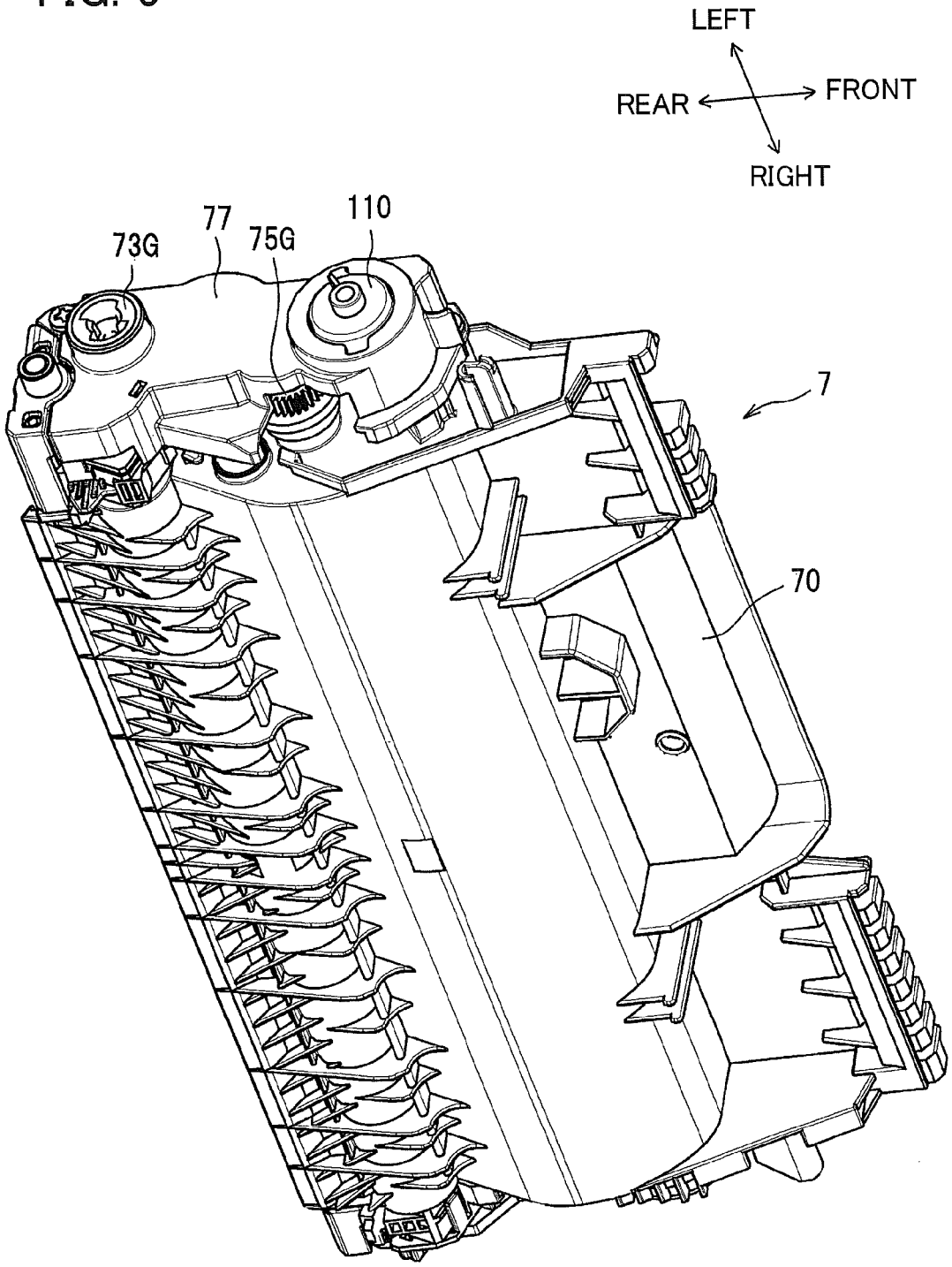
FIG. 5 is a perspective view of the developing unit according to the first embodiment as viewed from below.

When the developing unit 7 is viewed from its bottom, as shown in FIG. 5, a bottom portion of the agitator gear 75G is exposed through the cover 77. When the developing unit 7 is mounted in the drum unit 6, the agitator gear 75G engages with the inner gear part 64A of the transmission gear 64 shown in FIG. 4B. In other words, the drum unit 6 is configured such that the driving force from the developing unit 7 is inputted into the second sensor gear 210. This construction can contribute to a lower production cost than when separate structures are provided for inputting driving forces into the first sensor gear 110 and second sensor gear 210.

The second sensor gear 210 primarily includes a gear part 211, and a second detected part 215. The second sensor gear 210 is configured so that the second detected part 215 is irreversibly rotated (displaced) from the new-product position shown in FIG. 7 to the used position shown in FIG. 9.

As shown in FIG. 4B, the gear part 211 is arranged such that its circumferential surface confronts the outer gear part 65B of the transmission gear 65. The gear part 211 has a circumferential surface on which the toothed portion 212 and a toothless portion 213 are provided. When the toothed portion 212 is positioned opposite the outer gear part 65B and is engaged with the gear teeth of the outer gear part 65B, a driving force can be transmitted from the transmission gear 65 to the toothed portion 212 for rotating the second sensor gear 210. However, when the toothless portion 213 faces the outer gear part 65B, a driving force cannot be transmitted from the transmission gear 65 and thus the second sensor gear 210 is not rotated.

The second detected part 215 is provided on a right surface of the gear part 211. The second detected part 215 protrudes rightward from the gear part 211 at a position offset radially from a rotational center thereof.

Figure 7:
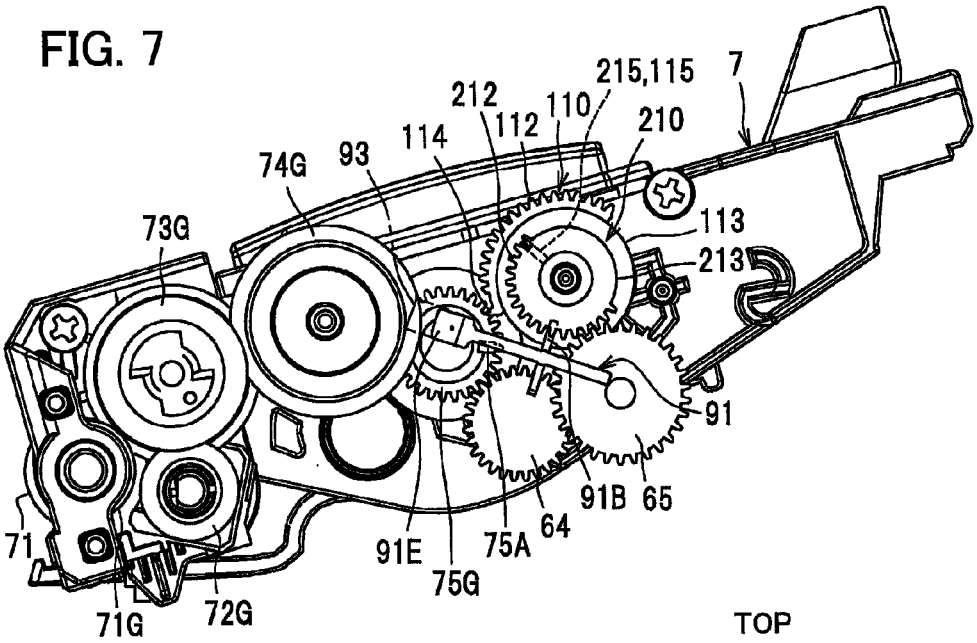
FIG. 7 is a side view of a process cartridge of the first embodiment in which the new developing unit according to the first embodiment is mounted in the new drum unit according to the first embodiment, wherein a portion of the drum unit and the developing unit are shown.
Figure 7:
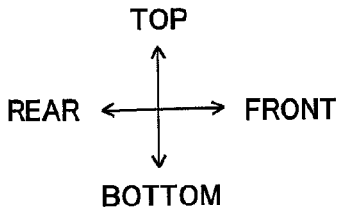

As shown in FIG. 7, the first sensor gear 110 and second sensor gear 210 are juxtaposed (aligned with each other) in the left-right direction (axial direction) when the developing unit 7 is mounted in the drum unit 6 (only the transmission gears 64 and 65 and the second sensor gear 210 are shown in FIG. 7). This arrangement enables the process cartridge 5 to be made more compact vertically than a structure in which the second sensor gear 210 is positioned above the first sensor gear 110, for example.

3. Structure of the Laser Printer Related to Sensing a Process Cartridge

Figure 6:
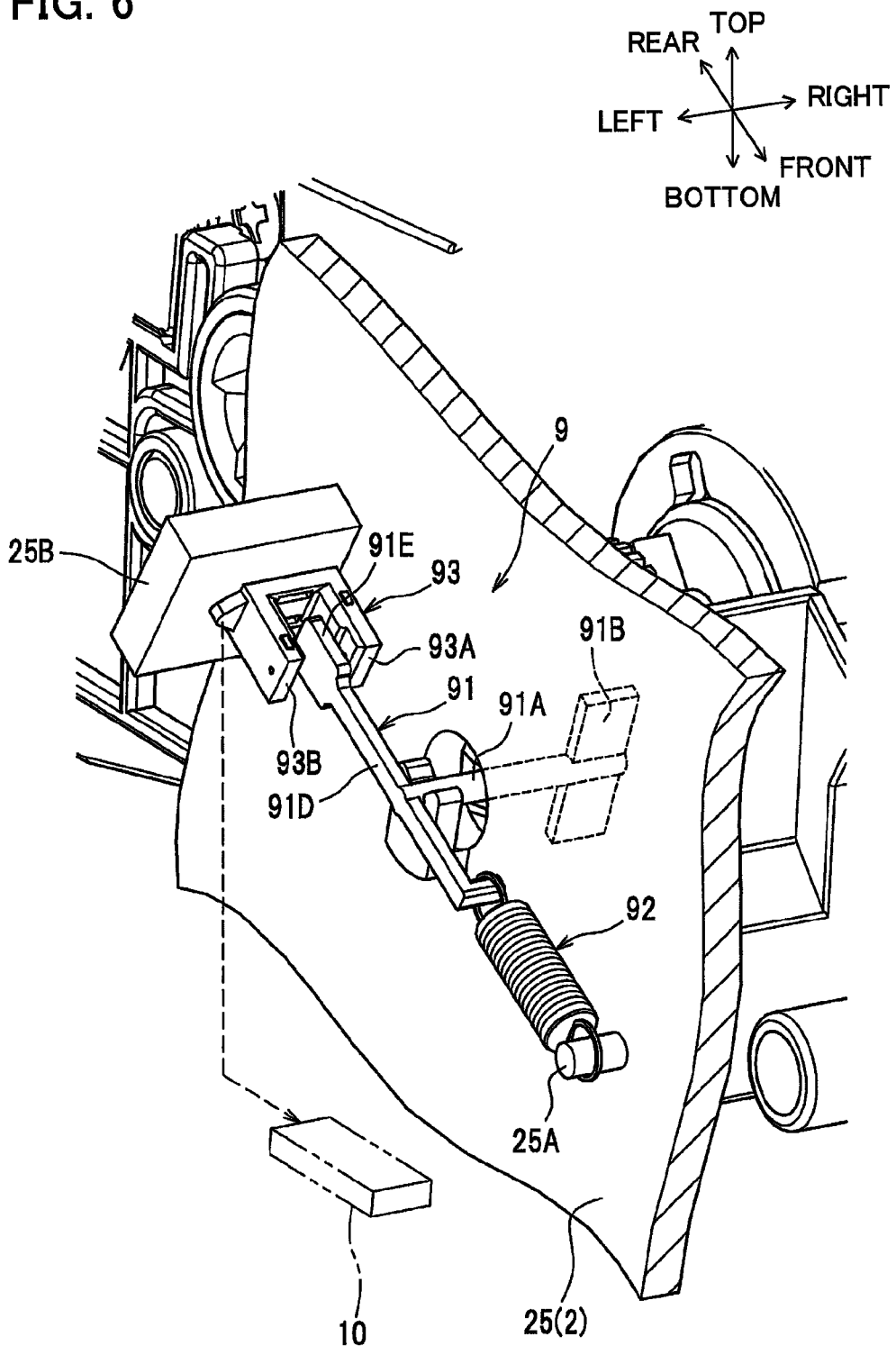
FIG. 6 is a perspective view showing a structure of a sensing mechanism provided in the laser printer according to the first embodiment, the sensing mechanism including a contact arm.

A detailed structure of the laser printer 1 concerned with sensing the process cartridge 5 (the drum unit 6 and developing unit 7) will be described next with respect to FIG. 6.

The laser printer 1 includes a drive mechanism (not shown) that is well known in the art. The drive mechanism can input a driving force into the input gear 73G of the process cartridge 5 (developing unit 7) while the process cartridge 5 is mounted in the main casing 2. The laser printer 1 is also provided with a sensing mechanism 9 and a control unit 10 shown in FIG. 6.

The sensing mechanism 9 is primarily configured of a pivotally movable contact arm 91, a coil spring 92 that applies a force to the contact arm 91 for returning the contact arm 91 to a non-contact state (hereinafter called a "non-detection position"), and a photosensor 93 for sensing the pivotal movement of the contact arm 91. The contact arm 91 pivotally moves when contacted by the first detected part 115 or second detected part 215.

The contact arm 91 primarily includes a shaft part 91A, a contact part 91B, and an arm part 91D. The shaft part 91A is rotatably supported on a wall 25 provided inside the main casing 2. Specifically, the contact part 91B is provided on a right end of the shaft part 91A, while the arm part 91D is provided on a left end of the shaft part 91A. The contact part 91B is provided on the right side of the wall 25 (the side nearest the process cartridge 5). The arm part 91D is provided on the left side of the wall 25 (the side opposite the process cartridge 5 with respect to the wall 25). The contact part 91B is a plate-shaped part that is arranged in a position for contacting the first detected part 115 and second detected part 215. The contact part 91B extends generally upward from the right end of the shaft part 91A in a radial direction of the shaft part 91A. The arm part 91D extends radially outward from the left end of the shaft part 91A in the general front-rear direction. A light-shielding part 91E having a plate shape is formed on a rear end of the arm part 91D.

The coil spring 92 has one end anchored on a front end of the arm part 91D, and another end anchored to a spring-anchoring part 25A formed on the left surface of the wall 25. In the present embodiment, the photosensor 93, shaft part 91A, and spring-anchoring part 25A fall along a general straight line when viewed in the left-right direction. Accordingly, when the first detected part 115 and second detected part 215 are not in contact with the contact arm 91, the urging force of the coil spring 92 urges the light-shielding part 91E toward the non-detection position between a light-emitting element 93A and a light-receiving element 93B described later.

The photosensor 93 is fixed to a sensor-mounting part 25B formed on the left surface of the wall 25. The photosensor 93 has the light-emitting element 93A and the light-receiving element 93B positioned to confront each other in the left-right direction. The light-emitting element 93A is configured to emit light toward the light-receiving element 93B, and the light-receiving element 93B is configured to receive the light emitted from the light-emitting element 93A. When the contact arm 91 is in the non-detection position, the light-shielding part 91E is positioned between the light-emitting element 93A and light-receiving element 93B, as shown in FIG. 6. Therefore, the light-receiving element 93B cannot receive the light from the light-emitting element 93A at this time. However, when the contact part 91B is contacted by the first detected part 115 or second detected part 215, the contact arm 91 pivotally moves, causing the light-shielding part 91E to move out from between the light-emitting element 93A and light-receiving element 93B. At this time, the light-receiving element 93B can receive the light emitted from the light-emitting element 93A. The light-receiving element 93B is configured to output a prescribed signal to the control unit 10 when light is received.

The control unit 10 functions to control operations of the laser printer 1. In the present embodiment, the control unit 10 executes an operation for driving the developing roller 71, supply roller 72, agitator 75, and the like in a preliminary rotation (hereinafter called an "idle rotation operation") when the process cartridge 5 is mounted in the main casing 2 (such as when a signal is received from a sensor provided for detecting opening and closing of the front cover 21 indicating that the front cover 21 has been closed). While the idle rotation operation will be described later in greater detail, the control unit 10 determines whether the drum unit 6 and developing unit 7 are new products during this operation based on the signal received from the light-receiving element 93B.

4. Operations for Detecting the Process Cartridge

Next, operations of the laser printer 1 for detecting the process cartridge 5 (drum unit 6 and developing unit 7) will be described with reference to FIGS. 7 through 11D.

When the first detected part 115 is in the new-product position shown in FIG. 7 (when the developing unit 7 is new), the first sensor gear 110 is oriented such that the protruding part 114 points generally toward the rotational center of the agitator gear 75G, and the toothed portion 112 is not engaged with the agitator gear 75G. On the other hand, when the second detected part 215 is in the new-product position (when the drum unit 6 is new), the second sensor gear 210 is oriented such that the toothed portion 212 faces and engages with the transmission gear 65 (outer gear part 65B). In the first embodiment, the first detected part 115 and second detected part 215 are disposed to overlap each other in the left-right direction when both are in the new-product position.

In order to execute the idle rotation operation, the control unit 10 controls the drive mechanism (not shown) when the process cartridge 5 is mounted in the main casing 2 to input a driving force into the process cartridge 5 (and specifically, the input gear 73G). When the driving force is inputted into the process cartridge 5, the driving force is transmitted from the agitator gear 75G to the toothed portion 212 of the second sensor gear 210 via the transmission gears 64 and 65, and the second sensor gear 210 begins to rotate.

Figure 8:
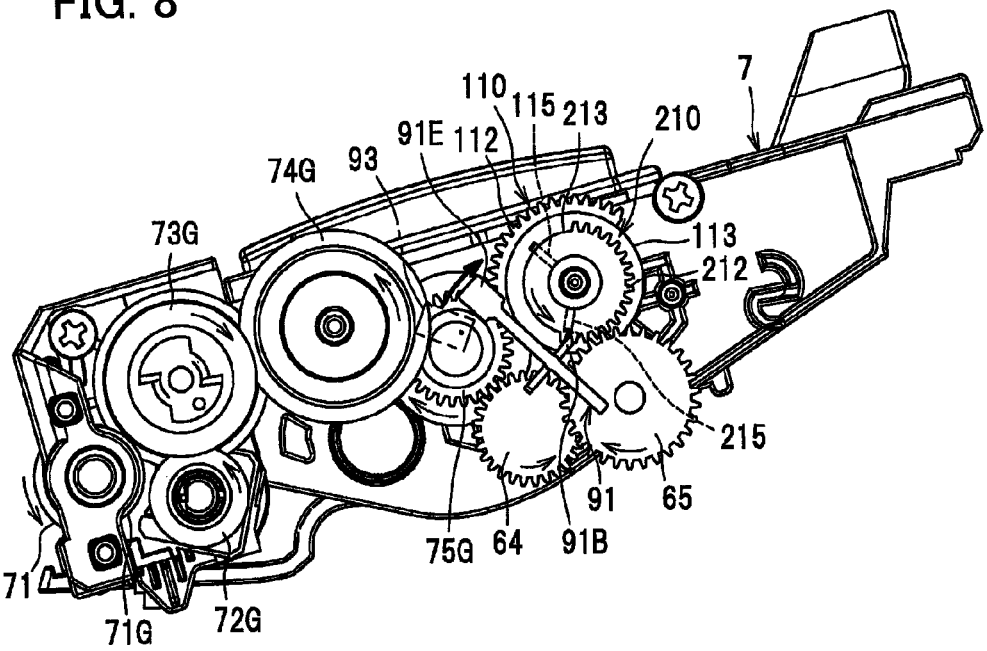
FIG. 8 is a side view of the process cartridge according to the first embodiment, wherein a second detected part of the second sensor gear has contacted the contact arm after the state shown in FIG. 7.

When the second sensor gear 210 rotates upon input of the driving force inputted from the main casing 2, the second detected part 215 is displaced counterclockwise from the new-product position shown in FIG. 7 to a position contacting the contact part 91B of the contact arm 91, as shown in FIG. 8. This contact forces the contact arm 91 to pivot. As the contact arm 91 pivots, the light-shielding part 91E is retracted from the photosensor 93 (from between the light-emitting element 93A and light-receiving element 93B), causing the light-receiving element 93B to detect light and output a signal to the control unit 10.

Figure 9:
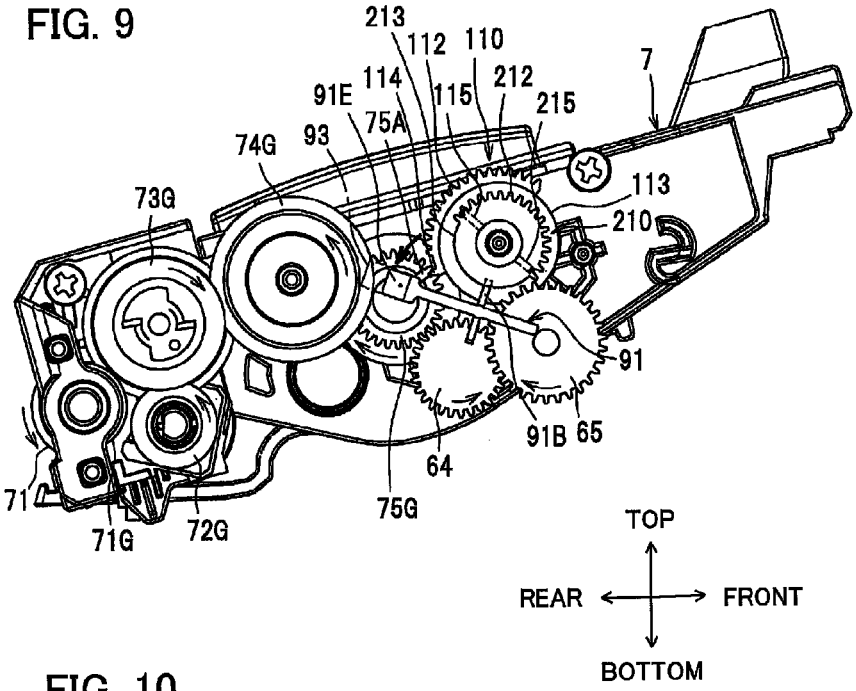
FIG. 9 is a side view of the process cartridge according to the first embodiment, wherein the second detected part has been displaced to a used position after the state shown in FIG. 8.

As the second sensor gear 210 continues to rotate, the second detected part 215 slides over the contact part 91B, allowing the contact arm 91 to return to its non-detection position, as shown in FIG. 9. At this time, the light-receiving element 93B no longer outputs a signal.

Figures 11A, 11B, 11C, 11D:
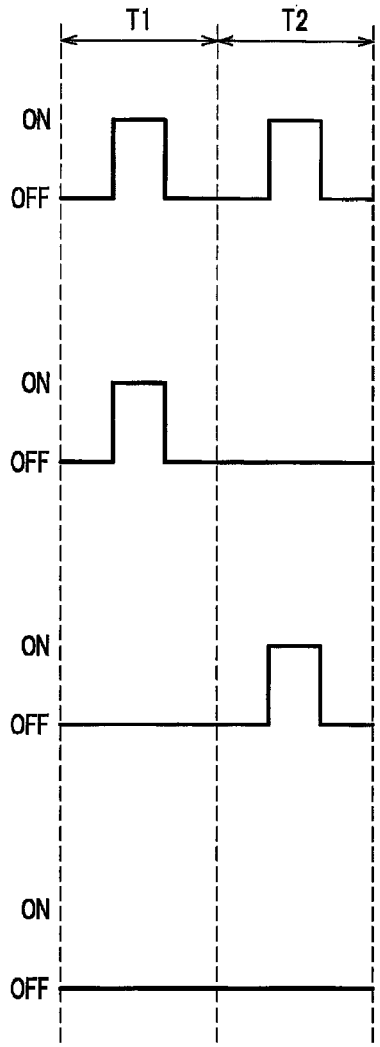
FIGS. 11A-11D are timing charts showing output of a photosensor according to the first embodiment.

As shown in FIGS. 11A and 11B, the control unit 10 determines that the drum unit 6 is new if the photosensor 93 outputs a signal (enters the ON state) and subsequently halts output of the signal (returns to the OFF state) within a predetermined first time interval T1 following the start of the idle rotation operation. After the second sensor gear 210 has rotated until the toothless portion 213 faces the transmission gear 65 and the second detected part 215 is displaced to the used position shown in FIG. 9, the driving force is no longer transmitted to the second sensor gear 210. Hence, the second sensor gear 210 comes to a halt and can no longer rotate thereafter.

On the other hand, if the second detected part 215 of the drum unit 6 mounted in the main casing 2 is already in the used position when the control unit 10 begins the idle rotation operation, the sensing mechanism 9 will not detect the second detected part 215 (the OFF state of the photosensor 93 will be continuous) during the first time interval T1, as in the examples of FIGS. 11C and 11D. Consequently, the control unit 10 will determine that the drum unit 6 is a used product.

Through the current stage of the process described above, the first sensor gear 110 has remained motionless because the toothed portion 112 is not engaged with the agitator gear 75G. However, the protruding part 75A of the agitator gear 75G also moves along with the rotation of the agitator gear 75G and contacts the protruding part 114 of the first sensor gear 110. When the protruding part 114 is pushed by the protruding part 75A, the first sensor gear 110 begins to rotate counterclockwise in the drawings so that the toothed portion 112 becomes engaged with the agitator gear 75G. Through this engagement, a driving force is inputted into the toothed portion 112 from the main casing 2, rotating the first sensor gear 110.

Figure 10:
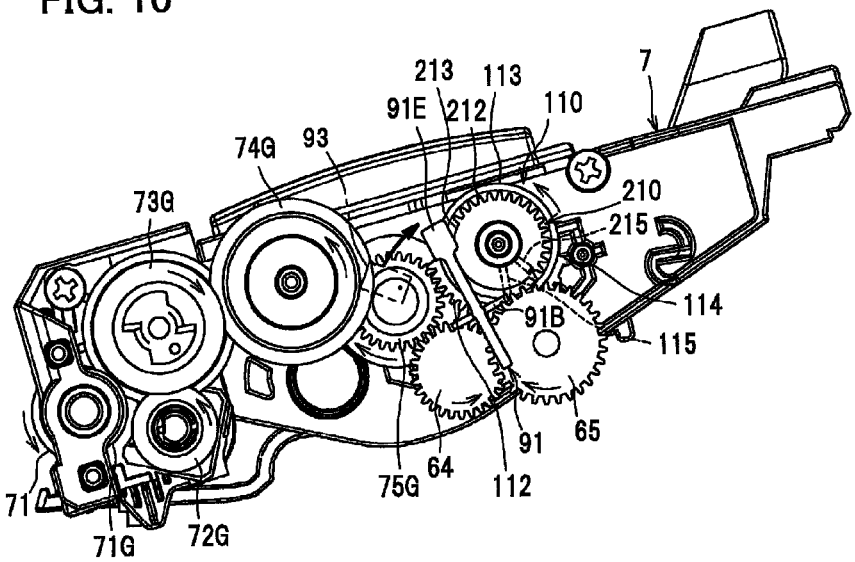
FIG. 10 is a side view of the process cartridge according to the first embodiment, wherein a first detected part of the first sensor gear has contacted the contact arm after the state shown in FIG. 9.

As the first sensor gear 110 rotates, the first detected part 115 is displaced counterclockwise in the drawings from the new-product position and contacts the contact part 91B of the contact arm 91, as shown in FIG. 10. As in the case of the second detected part 215, contact from the first detected part 115 causes the contact arm 91 to pivot so that the photosensor 93 outputs a signal to the control unit 10. Although not illustrated in the drawings, the first detected part 115 slides over the contact part 91B as the first sensor gear 110 continues to rotate, allowing the contact arm 91 to return to its non-detection position and halting signal output to the control unit 10.

As illustrated in FIGS. 11A and 11C, the control unit 10 determines that the developing unit 7 is new when the photosensor 93 outputs a signal (enters the ON state) and subsequently halts output of the signal (returns to the OFF state) during a predetermined second time interval T2 following the first time interval T1. While not shown in the drawings, after the first sensor gear 110 has rotated so that the toothless portion 113 faces the agitator gear 75G and the first detected part 115 has been displaced to the used position, the driving force is no longer transmitted to the first sensor gear 110. Accordingly, the first sensor gear 110 is halted and cannot rotate thereafter.

If the control unit 10 initiates the idle rotation operation after a developing unit 7 having a first detected part 115 in the used position is mounted in the main casing 2, the sensing mechanism 9 will not detect the first detected part 115 during the second time interval T2, as illustrated in FIGS. 11B and 11D. In this case, the control unit 10 determines that the developing unit 7 is a used product.

Therefore, if both the drum unit 6 and developing unit 7 of the mounted process cartridge 5 are new, the sensing mechanism 9 will detect both the first detected part 115 and the second detected part 215. Accordingly, the signal outputted from the photosensor 93 will change according to the sequence OFF-*ON-*OFF within each of the first time interval T1 and second time interval T2, as in the example of FIG. 11A. On the other hand, if only the drum unit 6 is new, the sensing mechanism 9 will only detect the second detected part 215 and the changes in signal state will occur only in the first time interval T1, as in the example of FIG. 11B. If only the developing unit 7 is new, then the sensing mechanism 9 will detect only the first detected part 115 and the signal changes will appear only in the second time interval T2, as in the example of FIG. 11C. If both the drum unit 6 and developing unit 7 are used products, then the sensing mechanism 9 will detect neither the first detected part 115 nor the second detected part 215 and the signal will remain unchanged (in the OFF state) during both the first time interval T1 and second time interval T2, as in the example of FIG. 11D.

According to the first embodiment described above, the sensing mechanism 9 can detect both the first detected part 115 (the developing unit 7) and the second detected part 215 (the drum unit 6). Therefore, there is no need to provide separate detecting means for each of the drum unit 6 and developing unit 7, enabling the drum unit 6 and developing unit 7 to be detected at a lower cost.

Further, since the first detected part 115 and second detected part 215 are configured to contact the contact arm 91 (sensing mechanism 9) at different timings in the present embodiment, the sensing mechanism 9 can differentiate between contact by the first detected part 115 and contact by the second detected part 215, thereby enabling separate detection of the first detected part 115 and second detected part 215.

Further, since the driving force from the main casing 2 is transmitted to the drum unit 6 via the developing unit 7 in the present embodiment, separate mechanisms for inputting a driving force to each of the drum unit 6 and the developing unit 7 are not necessary to be provided in the laser printer 1. This construction contributes to a reduction in production cost.

Second Embodiment

Next, a second embodiment of the present invention will be described with reference to FIGS. 12A-14D, wherein like parts and components are designated with the same reference numerals with those of the first embodiment to avoid duplicating description.

The drum unit 6 of the second embodiment is provided with a second sensor gear 220, instead of the second sensor gear 210. The developing unit 7 has the same configuration as the first embodiment.

Figure 12A:
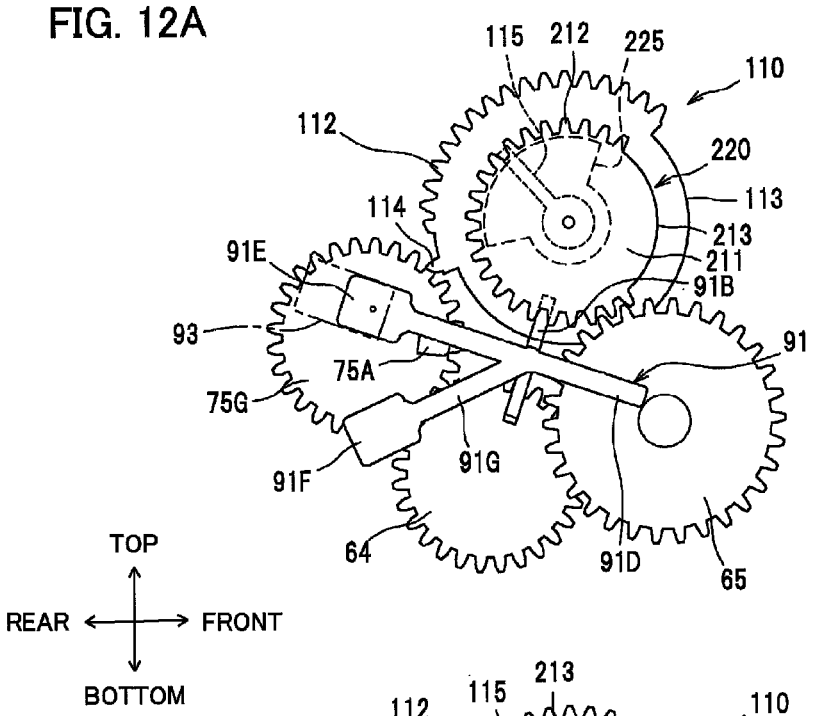
FIG. 12A is a side view showing a configuration of first and second sensor gears and peripheral components, including a contact arm, according to a second embodiment of the present invention, wherein both of first and second detected parts are in a new-product position.

As shown in FIG. 12A, the second sensor gear 220 of the second embodiment primarily includes the gear part 211 having the toothed portion 212 and toothless portion 213, and a second detected part 225.

The second detected part 225 is provided on the right surface of the gear part 211. The second detected part 225 has a fan-like shape in a left-right view and protrudes rightward (away from the viewer in FIG. 12) from the gear part 211 at a position offset radially from the rotational center thereof. The fan-shaped second detected part 225 has an arc-shaped outer peripheral edge that is configured to contact the contact arm 91.

The contact arm 91 of the second embodiment primarily includes the shaft part 91A (see FIG. 6), the contact part 91B, the arm part 91D, an offshoot arm 91G, a first light-shielding part 91E, and a second light-shielding part 91F.

When the contact arm 91 is in a non-contact state, the first light-shielding part 91E is positioned inside the photosensor 93 (between the light-emitting element 93A and light-receiving element 93B) for interrupting light emitted from the light-emitting element 93A, as in the first embodiment. The first light-shielding part 91E is formed in a shape identical to the light-shielding part 91E described in the first embodiment.

The offshoot arm 91G extends diagonally downward and rearward from a point near the center of the arm part 91D. The second light-shielding part 91F has a plate shape and is provided on a distal end of the offshoot arm 91G.

First, to facilitate understanding of the second embodiment, operations for sensing the process cartridge 5 will be described for a process cartridge 5 in which only the drum unit 6 is new. In this description, movement of the first sensor gear 110 depicted in the drawings will be ignored since the contact arm 91 (sensing mechanism 9) does not detect the first detected part 115 of the developing unit 7, as described in the first embodiment.

Figure 12B:
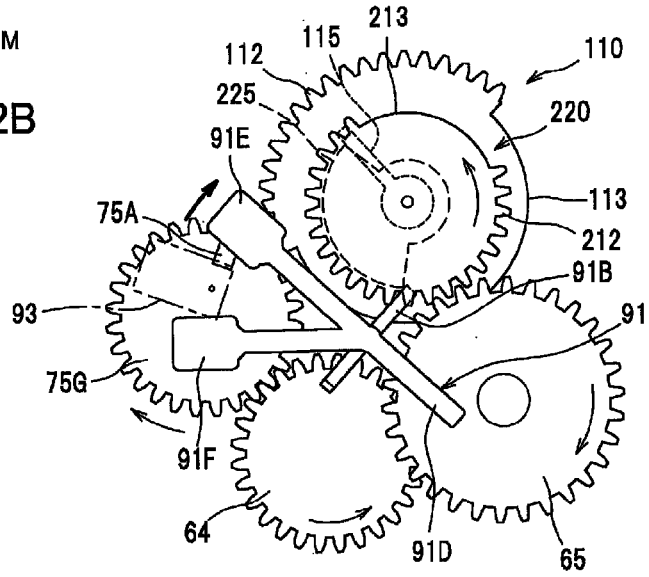
FIG. 12B is a side view showing the configuration of the first and second sensor gears and peripheral components, including the contact arm, according to the second embodiment, wherein the second detected part is in contact with the contact arm.

When the second sensor gear 220 rotates from the driving force inputted from the agitator gear 75G, the second detected part 225 is displaced from the new-product position shown in FIG. 12A to a position contacting the contact part 91B of the contact arm 91, as shown in FIG. 12B. This contact forces the contact arm 91 to pivot. As the contact arm 91 pivots, the first light-shielding part 91E is retracted from the photosensor 93, causing the photosensor 93 to detect light and to output an ON signal to the control unit 10. Since the outer peripheral edge of the second detected part 225 that contacts the contact arm 91 has an arc shape in the second embodiment, the second detected part 225 maintains contact with the contact arm 91 for a prescribed time (fourth time interval T4 described later). While not illustrated in the drawings, the second detected part 225 slides over the contact part 91B as the second sensor gear 220 continues to rotate. Once contact between the second detected part 225 and contact part 91B is released, the contact arm 91 returns to its non-detection position, causing the photosensor 93 to stop outputting the ON signal to the control unit 10 and to enter an OFF state.

Figures 14A, 14B, 14C, 14D:
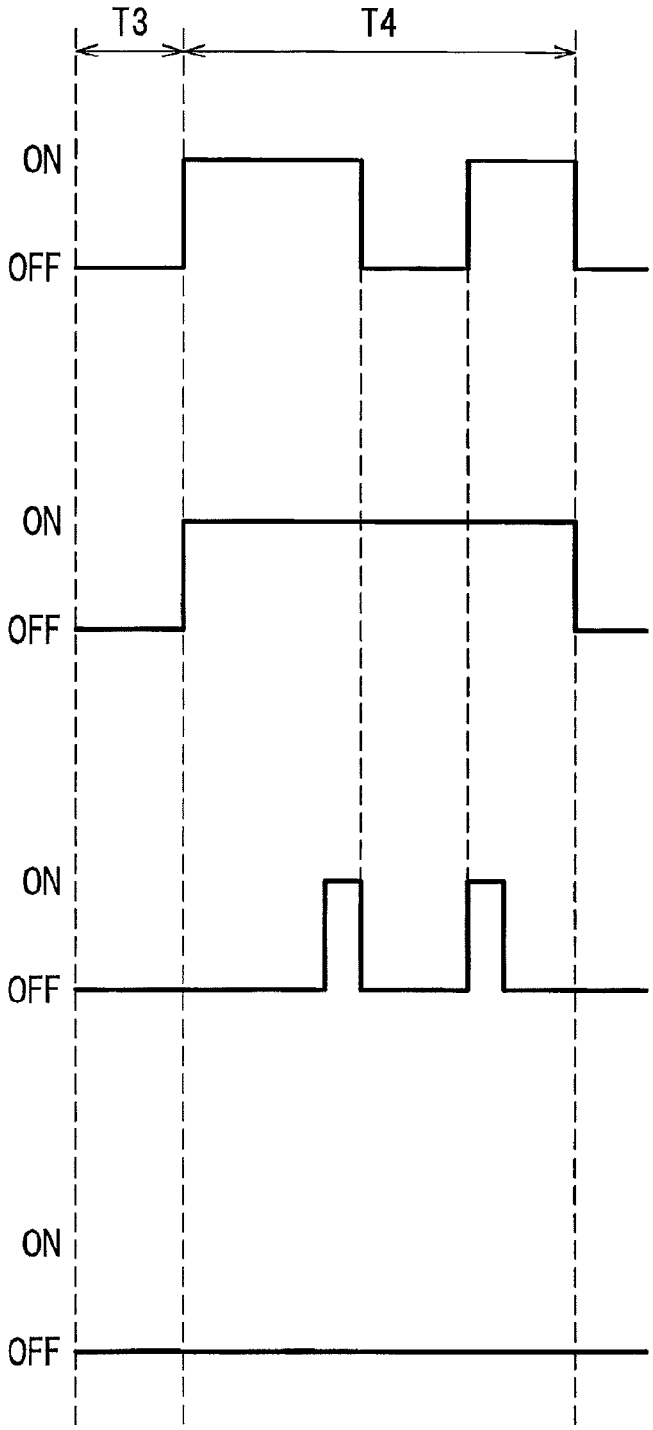
FIGS. 14A-14D are timing charts showing output of a photosensor according to the second embodiment.

As shown in FIG. 14B, the control unit 10 determines that the drum unit 6 is new if an ON signal is detected after a predetermined third time interval T3 following the start of the idle rotation operation, and again detects an OFF state after an additional predetermined fourth time interval T4 following the third time interval T3. After the second sensor gear 220 has rotated until the toothless portion 213 faces the transmission gear 65 and the second detected part 225 is displaced to the used position, the second sensor gear 220 comes to a halt and can no longer rotate thereafter. Accordingly, the contact arm 91 will no longer detect the second detected part 225. Hence, when a drum unit 6 whose second detected part 225 is already in the used position is mounted in the main casing 2, the control unit 10 will determine that the drum unit 6 is a used product because the signal variations described above are not detected.

Based on the above description, operations for sensing a process cartridge 5 in which both the drum unit 6 and developing unit 7 are new will be described next.

When a driving force is inputted from the agitator gear 75G, the second sensor gear 220 rotates, as illustrated in FIGS. 12A and 12B, until the second detected part 225 contacts the contact arm 91, causing the contact arm 91 to pivot. Due to the pivoting contact arm 91, the photosensor 93 begins outputting an ON signal to the control unit 10 after the third time interval T3 has elapsed, as illustrated in FIG. 14A.

Subsequently, the protruding part 75A of the agitator gear 75G contacts the protruding part 114 of the first sensor gear 110 while the second detected part 225 is still in contact with the contact arm 91, and the first sensor gear 110 begins to rotate. As the first sensor gear 110 rotates, the first detected part 115 is displaced from the new-product position shown in FIG. 12B and comes into contact with the contact part 91B of the contact arm 91 when the second detected part 225 is still in contact with the same, as shown in FIG. 13A.

Figure 13A:
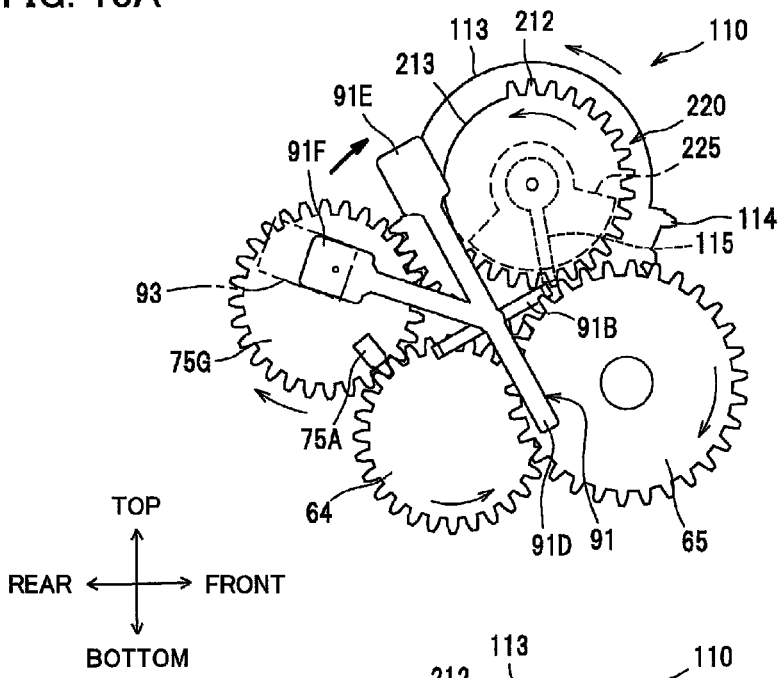
FIG. 13A is a side view showing the configuration of the first and second sensor gears and peripheral components, including the contact arm, according to the second embodiment, wherein the first detected part contacts the contact arm while the second detected part is in contact with the contact arm.
Figure 13B:
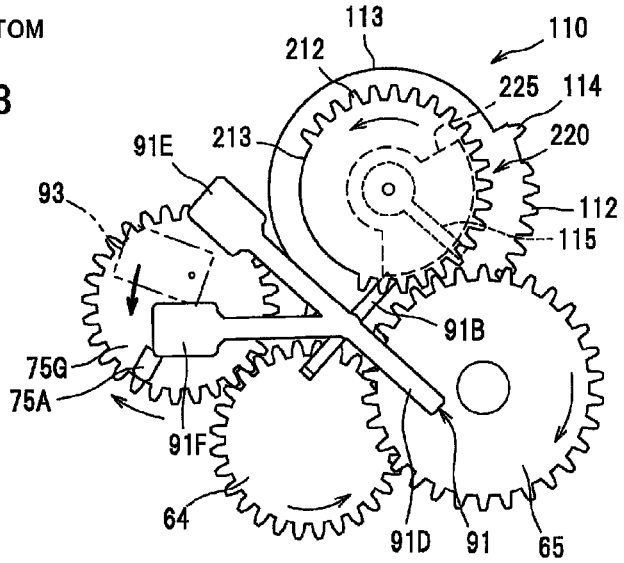
FIG. 13B is a side view showing the configuration of the first and second sensor gears and peripheral components, including the contact arm, according to the second embodiment, wherein the contact between the first detected part and the contact arm is broken while the second detected part remains in contact with the contact arm.

As the contact arm 91 pivots clockwise in the drawings from the position shown in FIG. 12B to the position shown in FIG. 13A, the second light-shielding part 91F moves to a position between the light-emitting element 93A and light-receiving element 93B to interrupt the light emitted from the light-emitting element 93A. As the first sensor gear 110 continues to rotate, the first detected part 115 slides over the contact part 91B and separates from the contact arm 91, as illustrated in FIG. 13B. At this time, the contact arm 91 returns to a state of contact only with the second detected part 225, and the light-receiving element 93B once again receives light.

Through the process described above, the photosensor 93 halts output of the ON signal to the control unit 10 and enters an OFF state, then subsequently resumes outputting the ON signal to the control unit 10, all within the fourth time interval T4. In the preferred embodiment, the control unit 10 determines that the developing unit 7 is new when the signal changes and returns to the original state. When the drum unit 6 and developing unit 7 of the process cartridge 5 are both new, the signal outputted when sensing the process cartridge 5 first changes from ON to OFF and back to ON again. From this variation, the control unit 10 can determine that the developing unit 7 is new.

After the control unit 10 determines that the developing unit 7 is new, the second sensor gear 220 continues to rotate and the second detected part 225 slides off the contact part 91B, halting output of the ON signal to the control unit 10. Since the control unit 10 detects the OFF state at the point the fourth time interval T4 has elapsed, the control unit 10 determines that the drum unit 6 is new.

Next, operations for sensing a process cartridge 5 will be described for a case in which only the developing unit 7 is new. In this case, the contact arm 91 does not detect the second detected part 225 of the drum unit 6. Therefore, only the first detected part 115 contacts the contact arm 91.

As the first sensor gear 110 rotates, the first detected part 115 is displaced from the new product position shown in FIG. 12A and contacts the contact arm 91, causing the contact arm 91 to pivot so that the first light-shielding part 91E is retracted from the photosensor 93 (see FIG. 12B). The contact arm 91 continues to pivot until the second light-shielding part 91F is positioned between the light-emitting element 93A and light-receiving element 93B, as shown in FIG. 13A. As the first sensor gear 110 continues to rotate, the first detected part 115 slides over the contact arm 91, allowing the contact arm 91 to return from its state in FIG. 13A to its non-detection position shown in FIG. 12A, after passing through the state shown in FIG. 12B. Through this operation, the signal outputted to the control unit 10 changes in the order OFF→ON→OFF→ON→OFF during the fourth time interval T4, as illustrated in FIG. 14C. Accordingly, the control unit 10 determines that the developing unit 7 is new.

If both the drum unit 6 and developing unit 7 of the process cartridge 5 mounted in the main casing 2 are used, the contact arm 91 will detect neither the first detected part 115 nor the second detected part 225. Hence, the control unit 10 will detect no signal changes, as illustrated in FIG. 14D. In this case, the control unit 10 determines that both the drum unit 6 and developing unit 7 are used products.

As in the first embodiment, the sensing mechanism 9 according to the second embodiment can detect both the drum unit 6 and developing unit 7 at a low cost. Moreover, the sensing mechanism 9 in the second embodiment can detect contact by the first detected part 115 while detecting contact by the second detected part 225.

In the second embodiment, the first detected part 115 is configured to contact the contact arm 91 and subsequently separate from the same while the second detected part 225 remains in contact with the contact arm 91, but the opposite configuration may be used. Namely, the second detected part may be configured to contact the contact arm and subsequently separate from the same while the first detected part remains in contact with the contact arm.

Third Embodiment

A third embodiment of the present invention will be described with reference to FIGS. 15 to 17B, wherein like parts and components are designated with the same reference numerals with those of the first embodiment to avoid duplicating description.

Figure 15:
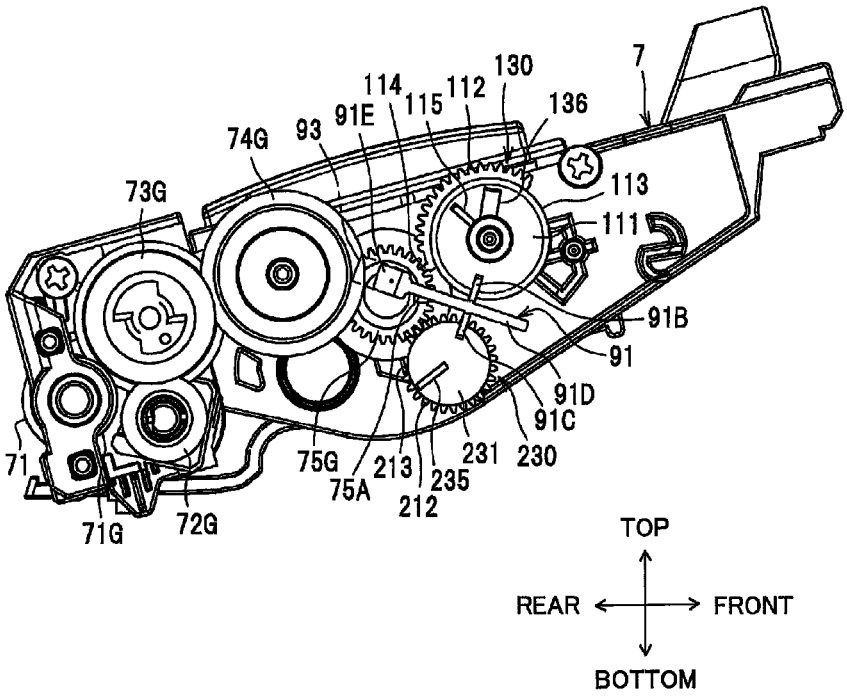
FIG. 15 is a side view of a new process cartridge according to a third embodiment of the present invention, wherein a first detected part and a second detected part are both in their new-product position.

As shown in FIG. 15, the drum unit 6 according to the third embodiment has a second sensor gear 230, and the developing unit 7 according to the third embodiment has a first sensor gear 130.

The second sensor gear 230 primarily includes a gear part 231 having the toothed portion 212, which is capable of engaging with the agitator gear 75G, and toothless portion 213; and a second detected part 235. The second detected part 235 is provided on a left surface of the gear part 231 and protrudes leftward from the gear part 231 at a position offset radially from a rotational center thereof.

The first sensor gear 130 is configured of the gear part 111 having the toothed portion 112, toothless portion 113, and protruding part 114; the first detected part 115; and a third detected part 136. The third detected part 136 is provided on the left surface of the gear part 111 and protrudes leftward from the gear part 111 at a position offset radially from the rotational center thereof and forward (upstream in the rotational direction) of the first detected part 115.

In the third embodiment, the first detected part 115 and second detected part 235 are provided on opposite sides of the contact arm 91 (the sensing mechanism 9) when the process cartridge 5 is mounted in the main casing 2. Further, the first sensor gear 130 and second sensor gear 230 are arranged in a generally vertical relationship with the contact arm 91 interposed therebetween when the process cartridge 5 is mounted in the main casing 2. This configuration enables the process cartridge 5 to be made more compact in the left-right dimension (the axial direction of the photosensitive drum 61).

The contact arm 91 primarily includes the shaft part 91A (see FIG. 6), a first contact part 91B, a second contact part 91C, the arm part 91D, and the first light-shielding part 91E. The first contact part 91B is formed in a shape identical to the contact part 91B described in the first embodiment. The second contact part 91C has a plate shape and extends radially outward (in a general downward direction) from the right end of the shaft part 91A.

Next, operations for sensing the process cartridge 5 will be described.

Figure 16A:
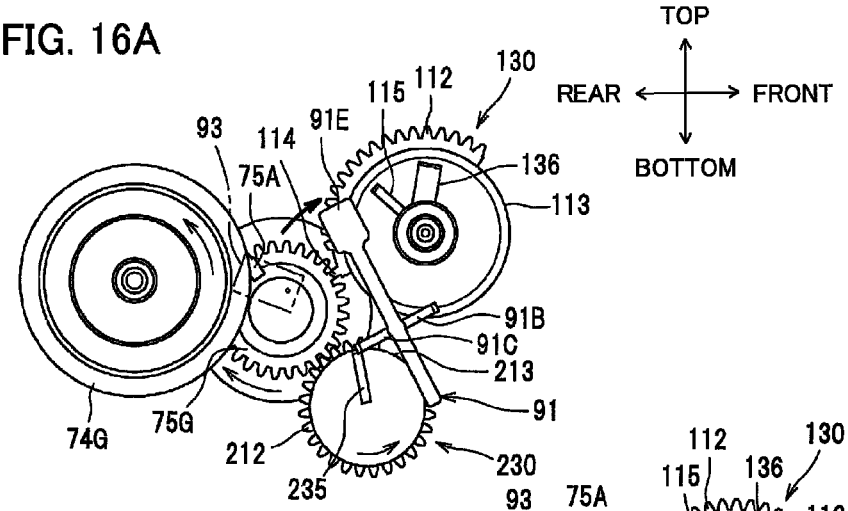
FIG. 16A is a side view showing a configuration of first and second sensor gears and peripheral components thereof (including a contact arm) according to the third embodiment, wherein the second detected part is in contact with the contact arm after the state shown in FIG. 15.

When a driving force is inputted from the main casing 2, the second sensor gear 230 begins to rotate and the second detected part 235 is displaced from the new-product position shown in FIG. 15 and contacts the second contact part 91C of the contact arm 91, as shown in FIG. 16A, causing the contact arm 91 to pivot upward. When the contact arm 91 pivots, the photosensor 93 outputs a signal to the control unit 10.

Figure 16B:
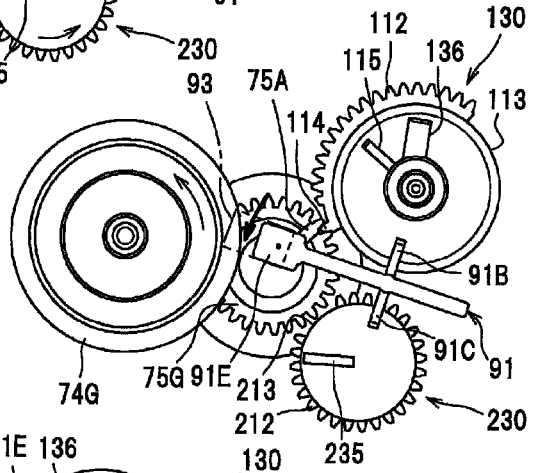
FIG. 16B is a side view showing the configuration of the first and second sensor gears and peripheral components thereof according to the third embodiment, wherein the second detected part has been displaced to its used position after the state shown in FIG. 16A.

As the second sensor gear 230 continues to rotate, the second detected part 235 slides over the second contact part 91C, allowing the contact arm 91 to return to its non-detection position as shown in FIG. 16B. As a result, the contact arm 91 halts output of the signal to the control unit 10, whereby the control unit 10 can determine that the drum unit 6 is a new product. When the toothless portion 213 subsequently confronts the agitator gear 75G and the second detected part 235 is displaced to the used position, the second sensor gear 230 comes to a halt and can no longer rotate thereafter.

Figure 16C:
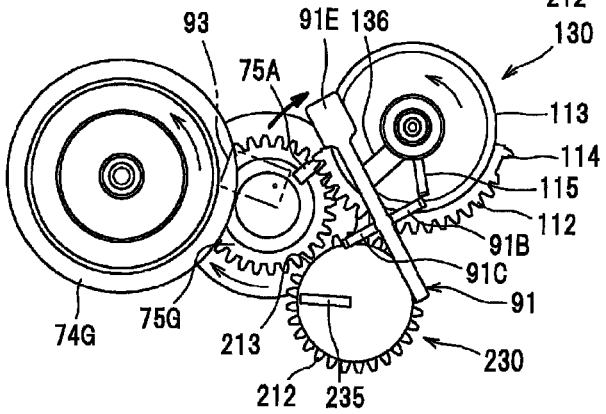
FIG. 16C is a side view showing the configuration of the first and second sensor gears and peripheral components thereof according to the third embodiment, wherein the first detected part is in contact with the contact arm after the state show in FIG. 16B.

In the meantime, the protruding part 75A contacts the protruding part 114, causing the first sensor gear 130 to begin rotating. As the first sensor gear 130 rotates, the first detected part 115 is displaced from the new-product position shown in FIG. 16B until the first detected part 115 contacts the first contact part 91B of the contact arm 91, as shown in FIG. 16C, causing the contact arm 91 to pivot upward. While not shown in the drawings, the first detected part 115 slides over the first contact part 91B as the first sensor gear 130 continues to rotate, allowing the contact arm 91 to return to the non-detection position. As a result, the control unit 10 determines that the developing unit 7 is a new product.

Figure 17A:
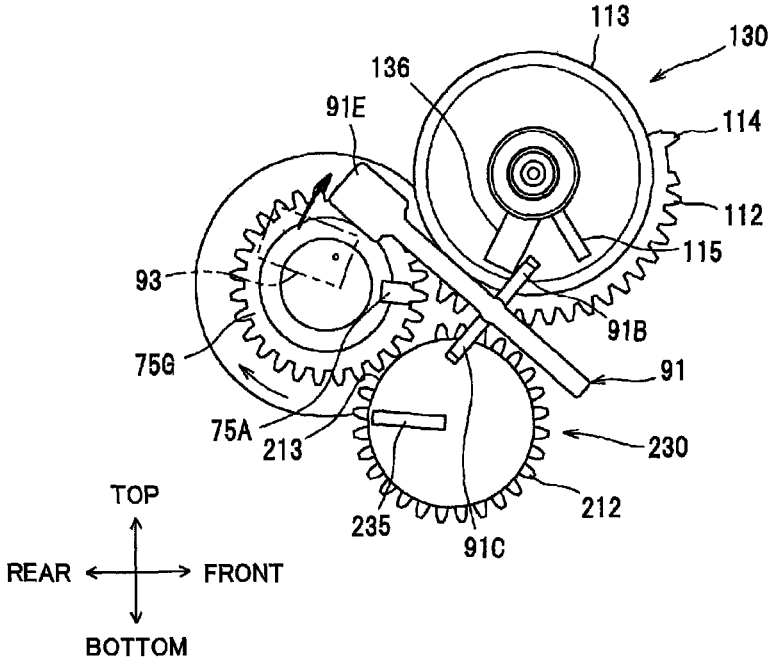
FIG. 17A is a side view showing the configuration of the first and second sensor gears and their peripheral components of a new process cartridge according to the third embodiment, wherein a third detected part provided on the first sensor gear is in contact with the contact arm after the state of FIG. 16C (after new-product detection is performed)

Once the toothless portion 113 has rotated opposite the agitator gear 75G and the first detected part 115 and third detected part 136 have been displaced to their used positions, as shown in FIG. 17A, the first sensor gear 130 comes to a halt and can no longer rotate thereafter. At this time, the third detected part 136 has contacted the first contact part 91B of the contact arm 91 and caused the contact arm 91 to pivot clockwise in the drawings. Consequently, the photosensor 93 outputs an ON signal to the control unit 10, enabling the control unit 10 to determine that the developing unit 7 (the process cartridge 5) is in the mounted state.

Figure 17B:
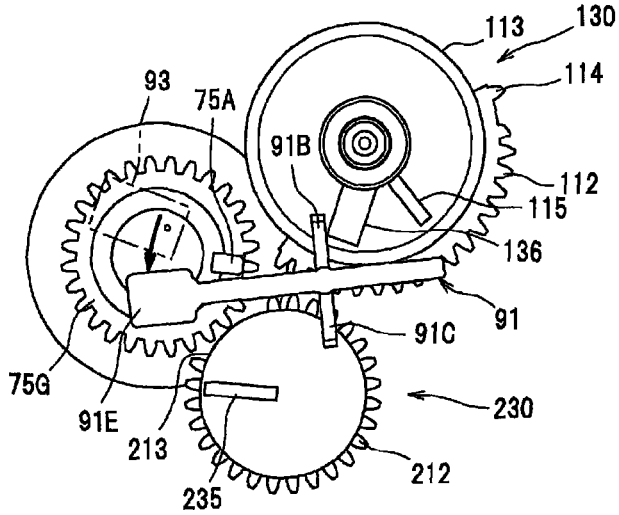
FIG. 17B is a side view showing the configuration of the first and second sensor gears and peripheral components of a used process cartridge according to the third embodiment, wherein the third detected part is in contact with the contact arm.

If both the first detected part 115 and second detected part 235 are in their used positions when the process cartridge 5 is mounted in the main casing 2, the contact arm 91 will detect neither the first detected part 115 nor the second detected part 235. Hence, the control unit 10 will determine that both the drum unit 6 and developing unit 7 are used. In this case, the third detected part 136 will still contact the first contact part 91B of the contact arm 91 as the process cartridge 5 is mounted in the main casing 2, causing the contact arm 91 to pivot counterclockwise in the drawings, as illustrated in FIG. 17B. Accordingly, the control unit 10 can detect that the process cartridge 5 is in a mounted state.

In the third embodiment described above, the sensing mechanism 9 can detect both the drum unit 6 and developing unit 7 at a low cost. Moreover, the sensing mechanism 9 according to the third embodiment can detect whether the process cartridge 5 is in a mounted state. Therefore, it is not necessary to provide separate means for detecting when the process cartridge 5 is in a mounted state, allowing for further reduction in manufacturing costs.

<Variations and Modifications>

In the first embodiment described above, the first detected part 115 and second detected part 215 cause the contact arm 91 to pivot in the same direction when contacting the contact arm 91, but the present invention is not limited to this configuration.

Figure 18:
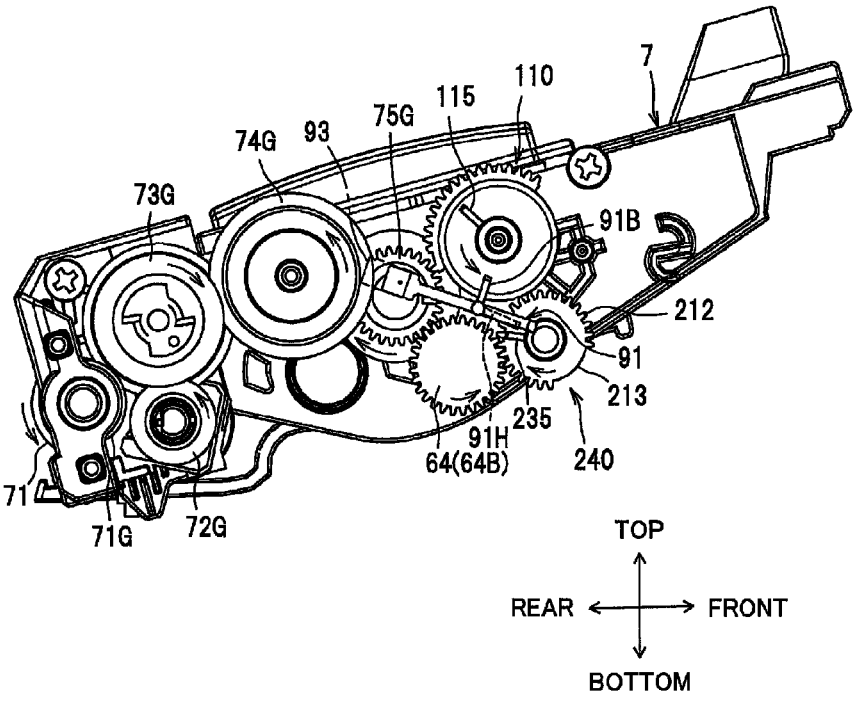
FIG. 18 is a side view showing a portion of a drum unit and a developing unit according to a first modification of the present invention.

For example, FIG. 18 shows a first modification of the present invention. The drum unit 6 of the first modification is provided with a second sensor gear 240. The second sensor gear 240 has the toothed portion 212 for engaging the outer gear part 64B of the transmission gear 64. In addition to the contact part 91B, the contact arm 91 of the first modification includes a second contact part 91H configured to be contacted by the second detected part 235 of the second sensor gear 240. With this configuration, the direction in which the contact arm 91 is pivoted when the first detected part 115 contacts the first contact part 91B can be opposite the direction in which the contact arm 91 pivots when the second detected part 235 of the second sensor gear 240 contacts the second contact part 91H.

However, the space required for displacing the contact arm 91 can be reduced when the first and second detected parts are configured to displace the contact arm 91 in the same direction, as in the first to third embodiments. Accordingly, the structures in the depicted embodiments make effective use of space inside the main casing 2, enabling the laser printer 1 to be made more compact. Further, configuring the first and second detected parts to displace the contact arm 91 in the same direction simplifies the structure for detecting contact by the first detected part while simultaneously detecting contact by the second detected part, as described in the second embodiment.

In the depicted first to third embodiments, the detected parts (the first detected part 115, second detected part 215, and the like) are provided on rotary bodies (the first sensor gear 110, second sensor gear 210, and the like), but the present invention is not limited to this configuration.

Figure 19:
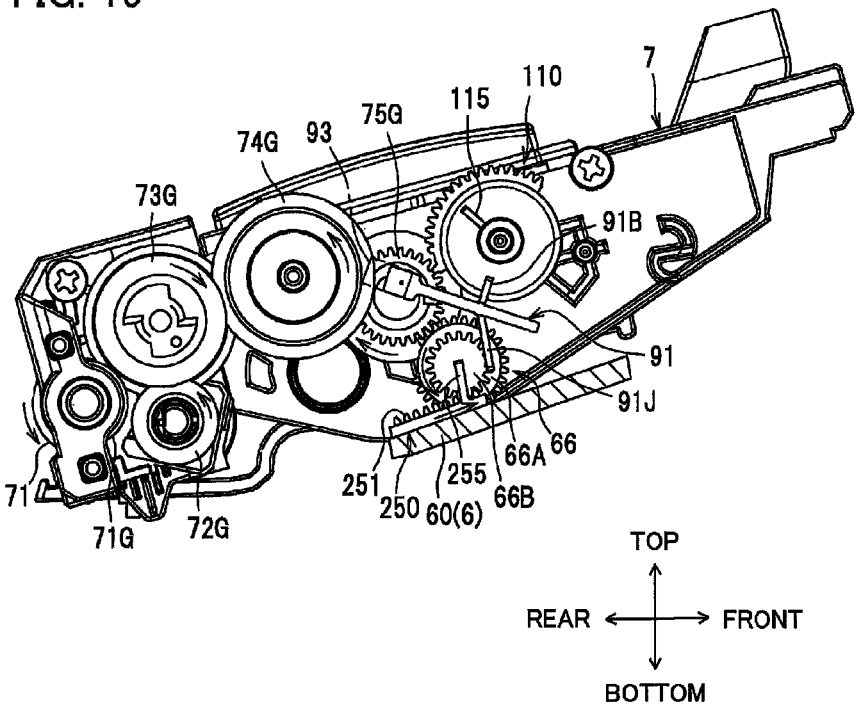
FIG. 19 is a side view showing a portion of a drum unit and a developing unit according to a second modification of the present invention.

For example, the detected parts may be provided on a movable body that can move in a prescribed direction. FIG. 19 shows an example of such configuration as a second modification of the present invention.

As shown in FIG. 19, the drum unit 6 of the second modification is provided with a transmission gear 66, and a movable body 250 on which a second detected part 255 is provided. More specifically, the transmission gear 66 includes an inner gear part 66A, and an outer gear part 66B. The inner gear part 66A has both a toothed part and a toothless part (not indicated with reference numerals in FIG. 19). When the toothed part confronts the agitator gear 75G, the driving force of the agitator gear 75G is transmitted to the inner gear part 66A. The outer gear part 66B is juxtaposed with the inner gear part 66A and rotates together with the same. The movable body 250 is supported on guides provided in the drum-unit frame 60 so as to be capable of sliding in the general front-rear direction. The movable body 250 has a rack gear part 251 that engages with the outer gear part 66B of the transmission gear 66. The second detected part 255 protrudes upward from a front end of the movable body 250.

With this configuration, when a driving force is transmitted from the agitator gear 75G to the inner gear part 66A, the outer gear part 66B rotating together with the inner gear part 66A and engaged with the rack gear part 251 moves the movable body 250 (and the second detected part 255) generally forward. The second detected part 255 contacts a second contact part 91J that protrudes in a general downward direction from the contact arm 91, causing the contact arm 91 to pivot. As the second detected part 255 slides over the second contact part 91J, the contact arm 91 is allowed to return to its non-detection position.

In the first and third embodiments described above, the first detected part 115 is configured to contact the contact arm 91 (sensing mechanism 9) after the sensing mechanism 9 has detected the second detected part 215 (or 235). However, the operations described in these embodiments may be performed in reverse order; namely, the second detected part may be configured to contact the sensing mechanism after the sensing mechanism has detected the first detected part.

In the embodiments described above, the developing unit 7 inputs a driving force into the drum unit 6 in order to displace the second detected part (the second detected part 215 and the like). However, the image forming apparatus may be configured to input the driving force from the device body into the drum unit directly, for example. Alternatively, the drum unit may be configured to transmit a driving force inputted from the device body into the developing unit for displacing the first detected part.

In the embodiments described above, the developing unit 7 having the developing roller 71 and toner-accommodating section 74 serves as the claimed first unit, and the drum unit 6 having the photosensitive drum 61 serves as the claimed second unit. However, the first unit may be a unit possessing a toner-accommodating section (such as a toner cartridge), while the second unit may be a unit possessing a photosensitive member and a developing roller.

The sensing mechanism 9 of the depicted embodiments employs the coil spring 92 for applying a biasing force to the contact arm 91. Instead of the coil spring, a torsion spring or a leaf spring may be available.

The laser printer 1 depicted in the first to third embodiments is a monochrome printer capable of forming black and white images only, but the present invention may also be applied to a color printer capable of forming colored images. Further, the present invention may also be embodied as a copier or a multifunction device provided with a scanning function, such as a flatbed scanner.

While the invention has been described in detail with reference to the specific embodiments thereof, it would be apparent to those skilled in the art that various changes and modifications may be made therein without departing from the spirit of the invention.

What is claimed is:

1. A process cartridge configured to be detachably mountable in an image forming apparatus provided with a detector, the process cartridge comprising:

a first unit configured to store toner therein;

a second unit provided with a photosensitive drum and configured to detachably accommodate the first unit, the photosensitive drum defining an axis extending in a first direction and configured to rotate about the axis, the second unit comprising a first detected body configured to move from a first position capable of receiving a driving force from the image forming apparatus to a second position incapable of receiving the driving force, the first detected body being configured to contact the detector while moving from the first position to the second position.

2. The process cartridge according to claim 1, wherein the first detected body is configured to rotate in a first rotating direction about a first axis parallel to the first direction, the first detected body having a circumference in the first rotating direction, the circumference having a portion formed with gear teeth.

3. The process cartridge according to claim 2, wherein the first detected body includes a protrusion protruding in the first direction, the protrusion being configured to contact the detector when the first detected body receives the driving force.

4. The process cartridge according to claim 1, wherein the first unit comprises a gear, and wherein the first detected body is configured to intermesh with the gear.

5. The process cartridge according to claim 4, wherein the first unit further comprises an agitator configured to agitate the toner, the agitator supporting the gear.

6. The process cartridge according to claim 1, wherein the first unit further comprises a second detected body configured to move from a third position capable of receiving the driving force from the image forming apparatus to a fourth position incapable of receiving the driving force, the second detected body being configured to contact the detector while moving from the third position to the fourth position.

7. The process cartridge according to claim 6, wherein the second detected body is configured to rotate in a second rotating direction about a second axis parallel to the first direction, the second detected body having a circumference in the second rotating direction, the circumference having a portion formed with gear teeth.

8. The process cartridge according to claim 7, wherein the second detected body includes a protrusion protruding in the first direction, the protrusion being configured to contact the detector when the second detected body receives the driving force.

9. The process cartridge according to claim 7, wherein the first unit comprises:

an agitator configured to agitate the toner and having one end in a direction parallel to the first direction; and a gear provided on the one end of the agitator, the second detected body being configured to intermesh with the gear.

10. The process cartridge according to claim 1, wherein the first unit comprises a developing roller configured to rotate about an axis parallel to the first direction.

* * * * *